United States Patent [19]

Singer

[11] 4,098,052

[45] Jul. 4, 1978

[54] WRAPPING APPARATUS AND METHOD

[76] Inventor: Alec Singer, 14 Mountain Rd., Claremont Cape Town, Cape Province, South Africa

[21] Appl. No.: 727,099

[22] Filed: Sep. 27, 1976

[30] Foreign Application Priority Data

Oct. 2, 1975 [ZA] South Africa ..... 75/6269

[51] Int. Cl.[2] ..... E04H 3/04

[52] U.S. Cl. ..... 53/33; 53/28; 53/30 S; 53/48; 53/209; 198/339; 198/606; 198/626

[58] Field of Search ..... 198/339, 606, 626, 793, 198/802; 53/30 S, 33, 48, 28, 180 R, 209

[56] References Cited

U.S. PATENT DOCUMENTS

| | | | |
|---|---|---|---|
| 2,986,857 | 6/1961 | Ganz | 53/48 |
| 3,190,050 | 6/1965 | Kirkpatrick | 53/33 |
| 3,239,991 | 3/1966 | Copping | 53/48 |
| 3,766,704 | 10/1973 | Ganz | 53/209 |

*Primary Examiner*—Othell M. Simpson
*Assistant Examiner*—W. D. Bray
*Attorney, Agent, or Firm*—Ladas, Parry, Von Gehr, Goldsmith & Deschamps

[57] ABSTRACT

The article being wrapped has a sheet of wrapping material draped over it so that it hangs down on each lateral side thereof. Initially the article travels on a conveyor which supports it along a central region. Thereafter the article is transferred to two supports which form part of two endless series and which travel with the conveyor. The supports are displaced laterally towards the conveyor while travelling with it until they are located beneath the edge regions of the article. The relative levels of the conveyor and supports are then changed so that the article is transferred to the supports. The supports and/or mechanical ploughs and/or air blasts overlap the hanging portions of the wrapping material along said central region. Thereafter the article is transferred to a further conveyor which engages the central region and holds the overlapping portions in place. Alternatively, air blasts can be used for this purpose, and where plastics film is being used, the air can be heated to seal the overlapping portions together.

14 Claims, 14 Drawing Figures

WRAPPING APPARATUS AND METHOD

THIS INVENTION relates to wrapping apparatus and to a method of wrapping.

According to one aspect of the present invention there is provided wrapping apparatus comprising conveying means for supporting an article being wrapped along a central region thereof, and two supporting means, there being a supporting means laterally spaced from, and on each side of, the conveying means for receiving the article being wrapped from the conveying means and for supporting the article along two edge regions thereof while leaving said central region unsupported, and drive means for displacing the conveying means and supporting means in a feed direction through the apparatus.

In one constructional form, the apparatus comprises a conveyor constituting the conveying means and two series of supports constituting the supporting means, there being a series of supports on each side of the conveyor, means for successively displacing the supports towards said conveyor from opposite sides thereof during movement in the feed direction and at a level below said conveyor, and guiding means for the conveyor and the supports for changing the relative levels of the conveyor and supports so as to bring the supports above the conveyor and thereby to transfer, from the conveyor to the supports, articles supported thereby whereby the articles then become supported along said edge regions by a support of each series.

More specifically, the apparatus can include a further conveyor and means for guiding the further conveyor and supports so that the relative levels thereof are changed whereby the further conveyor passes between the supports to a level above that of the supports thereby to lift from the supports the articles carried thereby and re-support the articles along said central region.

The first mentioned conveyor can be constituted by a first endless conveyor and the further conveyor is constituted by a second endless conveyor, the upper run of the first endless conveyor including a horizontal portion and a downwardly inclined portion and the upper run of the second endless conveyor including an upwardly inclined portion and a horizontal portion, there being two endless series of supports which travel along a horizontal run at a level which is below the horizontal portions of the first and second endless conveyors but above the lower ends of the inclined portions of such conveyors. Alternatively a single endless conveyor can be provided and a first portion of the upper run of such conveyor constitutes the first mentioned conveyor and a second portion of the upper run of such conveyor constitutes the further conveyor, the supports being guided along a run that commences below the level of said endless conveyor, slopes upwardly to a level above the upper run of said endless conveyor, and then slopes downwardly to a level below said upper run, there being means for maintaining the supports horizontal.

In yet another form the apparatus comprises means for directing air upwardly between said supporting means for holding overlapped wrapping material against the underside of an article being wrapped while the article is supported along said edge regions. Means for heating the air directed upwardly between said supporting means can be incorporated into the apparatus.

To assist in overlapping the edge portion, means for directing air obliquely with respect to the conveying means and supporting means can be provided for displacing to beneath the article being wrapped wrapping material hanging down to a level below said article on each side thereof.

According to a further aspect of the present invention there is provided a method of wrapping an article comprising placing a sheet of wrapping material over the article so that it hangs down below the article on each side thereof to form edge portions, supporting the article along a central region thereof on conveying means moving in a feed direction while leaving its edge regions unsupported, displacing the hanging edge portions of the wrapping material to beneath the article, transferring support of the article from the conveying means to supporting means which support the article along edge regions thereof with said material between said edge regions and the supporting means, said central region being unsupported, and securing said edge portions to one another along said central region.

In one form the method comprises moving supports transversely with respect to the feed direction to beneath the article from opposite sides thereof while the supports and conveying means move in the feed direction, and changing the relative level of the conveying means to transfer the articles from the conveying means to the supports.

Air can be blown onto said edge portions to force them into overlapping relationship with one another and juxtaposed to the underside of said article, and air can be blown upwardly against the overlapping edge portions to hold them juxtaposed. The air which is blown upwardly can be heated to seal said overlapping edge portions to one another.

The method can comprise the further step of subsequently re-supporting the article along said central region with said overlapped edge portions of said wrapping material held between the article and the means now supporting the article along the central region.

For a better understanding of the present invention reference will now be made, by way of example, to the accompanying drawings in which.

Figure 13:
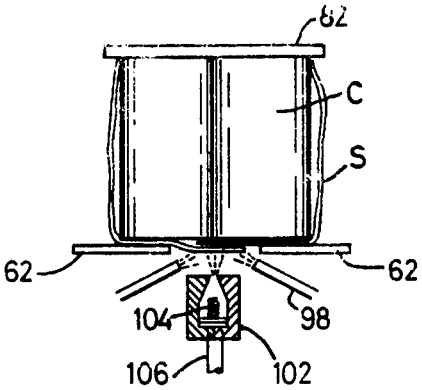

FIGS. 6 to 12 diagrammatically illustrate the mode of operation of the apparatus;

FIG. 13 illustrates a modified apparatus; and

Figure 14:
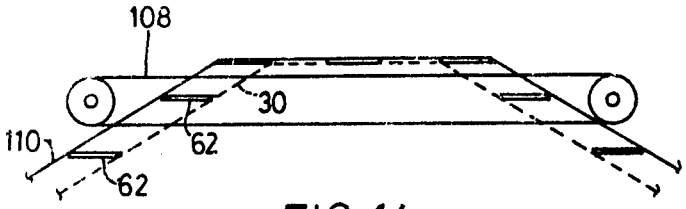

FIG. 14 a further modified form of apparatus.

Figure 3:
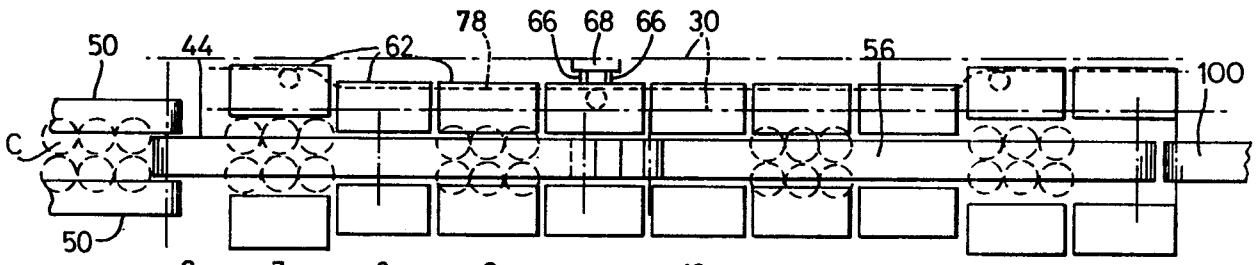
FIG. 3 is a diagrammatic top plan view which shows the moving belts and platforms of the apparatus.

The numbers 6 to 12 in FIG. 3 indicate the location of the cans C when wrapping has reached the conditions of FIGS. 6 to 12 respectively.

Figure 1:
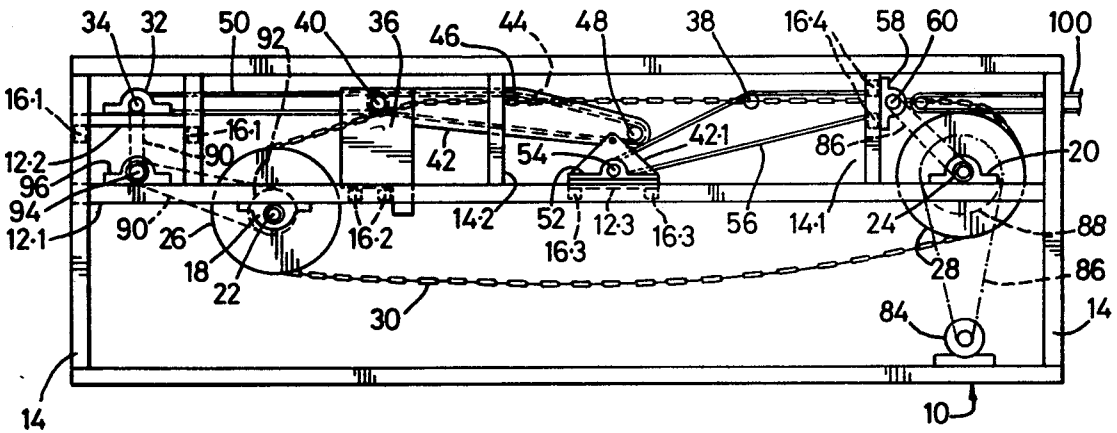
FIG. 1 is a side elevation of wrapping apparatus in accordance with the present invention.

Referring firstly to FIG. 1, the apparatus illustrated comprises two side frames 10, only one of which is illustrated, joined to one another by a plurality of transverse members thereby to form a stable and rigid machine frame. The illustrated side frame 10 includes an intermediate longitudinal member 12.1 and main uprights 14.

Bearings 18 and 20 are carried by the longitudinal member 12.1, the bearing 18 being beneath the longitudinal member and the bearing 20 being above the longitudinal member. These bearings serve to mount shafts 22 and 24 on each of which there are four sprocket wheels 26 and 28. The sprocket wheels 26 are arranged in pairs, there being two sprocket wheels on one side of the longitudinal center line of the apparatus and two on the other. The wheels 28 are similarly arranged and two pairs of chains 30 are entrained around these wheels (see also FIGS. 4 and 5. Each pair of chains carries a plurality of platforms as will be described in more detail hereinafter.

Extending between the side frames 10 are two transverse members 16.1 and these carry a longitudinally extending support 12.2 which is on the longitudinal centre line of the apparatus. This support carries bearings 32 for a shaft 34.

Two transverse members 16.2 extend between the longitudinal member 12.1 of the side frames 10, and these transverse members serve to mount a box-like structure 36. Within this structure there are bearings and these bearings mount a shaft 40.

Extending away from, and supported at one end by, the structure 36 is a casing 42 which serves to contain and guide a toothed belt 44. The casing 42 includes two side plates between which there is a belt guide plate, this plate being horizontal to the left of point 46 and sloping down to the right thereof. The casing 42 is also supported on brackets 42.1. The belt 44 is entrained around a pulley (not shown) carried on the shaft 40 and is also entrained around a further belt pulley (not shown) carried by a shaft 48. The shaft 48 is mounted at the end of the casing 42 remote from the structure 36. The belt guide plate prevents any tendency of the belt 44 to sag and thus ensures that its upper run follows exactly along the requisite path.

The shaft 34 carries a pair of spaced belt pulleys (not shown) and two toothed belts 50 are entrained around these pulleys. The shaft 40 carries three belt pulleys, the centre one having the belt 44 entrained therearound and the outer ones having the belts 50 entrained therearound. The arrangement of these belts can best be seen in FIG. 3.

Approximately half way along the longitudinal member 12.1 there are two further transverse members 16.3 and these serve to carry a further support 12.3 which is also on the center line. A bearing arrangement 52 is mounted on the support 12.3 and this arrangement carries a shaft 54. The shaft itself has a belt pulley (not shown) mounted thereon and the toothed belt which is entrained around this pulley is designated 56. A bearing arrangement 58 is mounted on transverse members 16.4 and this bearing arrangement carries a transverse shaft 60. At the centre of this shaft there is a belt pulley (not shown) and the belt 56 is entrained around this. It will be noted that the shaft 60 is above the shaft 54 and that there is a belt guide pulley shown at 38. This layout results in part of the upper run of the belt 56 being horizontal and the remainder inclined.

Figure 4:
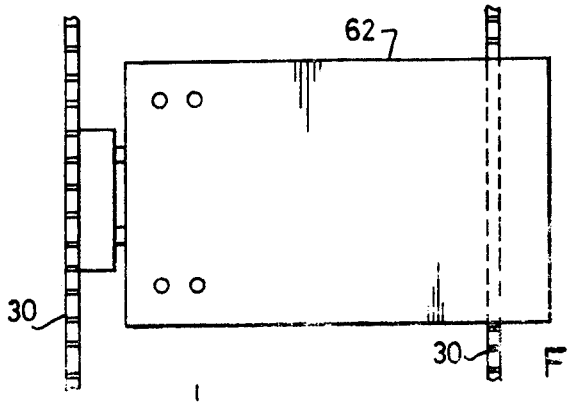
FIG. 4 is a top plan view, to a still larger scale, of a platform and its two associated chains.
Figure 5:
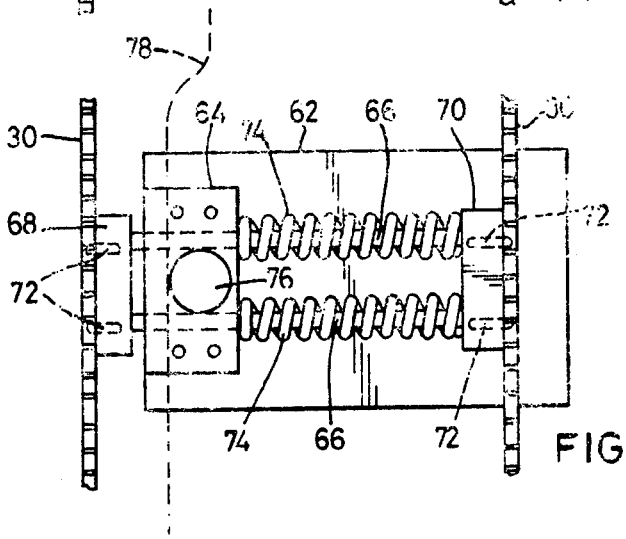
FIG. 5 is a underneath plan view of the platform of FIG. 4.

In FIGS. 4 and 5 two of the chains 30 are illustrated together with one of the plurality of platforms that are carried thereby. The platform is referenced 62 and forms a support for the articles being wrapped. Beneath each platform there is a block 64 through which two rods 66 freely pass. The ends of the rods 66 are carried in blocks 68 and 70 which are secured by pins 72 to the chains 30. Springs 74 are provided between the block 70 and the block 64 to urge the block 64 towards the block 68.

Beneath the block 64 there is a cam follower 76 in the form of a small wheel rotatable about an axis normal to the axes of the rods 66. The follower 76 co-operates with a cam track 78 which is diagrammatically illustrated. This track has not been shown in FIG. 1 but is diagrammatically shown in FIG. 3 and is carried by frame uprights 14.1 and 14.2 at the level of the horizontal upper run of the chains 30. There are, of course, two such cam tracks, one for each plurality of platforms, and the function of these tracks is to force the two sets of platforms towards one another and into close proximity with the belts 44 and 56 while the platforms are moving along their horizontal upper run.

Figure 2:
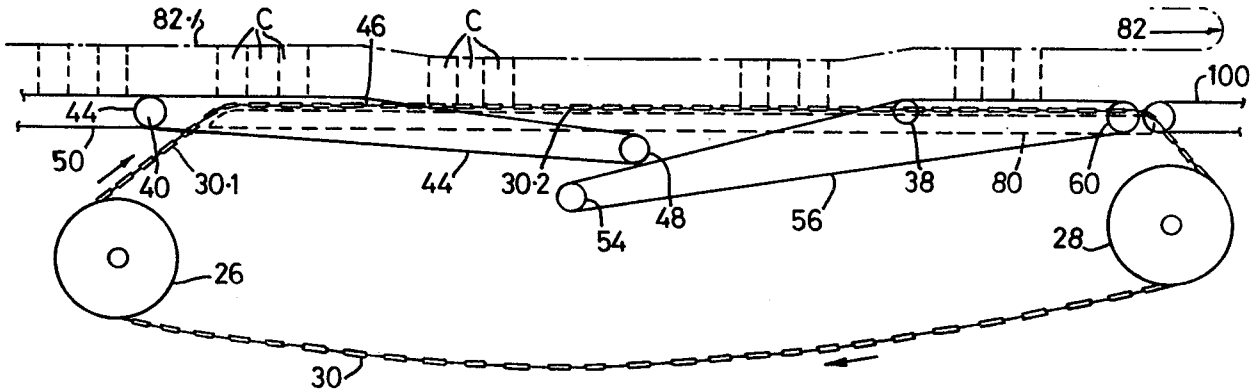
FIG. 2 is a diagrammatic side elevation, to a larger scale, illustrating the moving belts and chains of the apparatus.

In FIG. 2 a chain guide 80 is diagrammatically illustrated, there being one such chain guide for each of the four chains 30. As will clearly be seen, the chain guide ensures that the upper run of the chain is exactly horizontal and at the desired level with respect to the various belts. That this is essential will become apparent from the description of the mode of operation of the apparatus.

Figure 6:
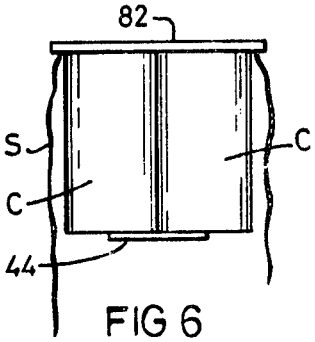
Figure 7:
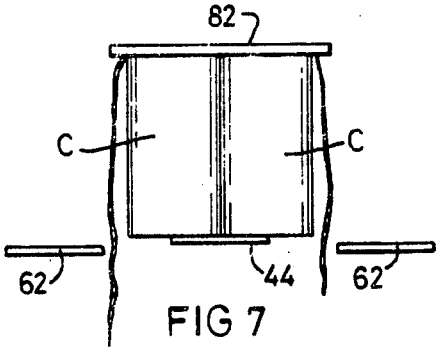

A belt 82 consisting of a plurality of rollers has been diagrammatically shown in FIGS. 2, 6 etc. This belt does not have a supporting function but rather presses down on the articles to be wrapped for the purpose to be described. The path of the lower run of this belt is marked 82.1 in FIG. 2 and guides (not shown) are provided for holding it to this path.

The main motor of the machine is shown at 84 and is located on one side of the machine frame. Chains and chain wheels 86 and 88 transmit drive from the motor to the shafts 24 and 60. Further chains 90 and chain wheels 92 link the shaft 22 to a shaft 94 carried by a bearing 96 and thence to the shaft 34. Thus the belts 50, 44, 56 and the chains 30 are all driven, and the ratios are such that their speeds are identical in the feed direction through the apparatus.

The apparatus illustrated is particularly intended to wrap, in shrink wrap material, groups of six cans C. The cans are "loose" in the sense that they are not held in fixed relationship to one another by any structure such as a tray or encircling band. However, it can also wrap grounds of articles such as bottles standing on a base tray or place a sheet of shrink wrap material around a number of articles in the form of rectangular packages which are to be held together as a unit. The cans are fed to the apparatus on the belts 50 in two rows with three cans in each row, as can be seen from FIG. 3, and travel from left to right in each of FIGS. 1 to 3. Relative movement of the cans is prevented by virtue of the fact that the belt 82 presses down on the cans so that they are, in effect, gripped between the belts 50 and the belt 82. The cans are transferred from the belts 50 to the belt 44 and, for a short while, are supported by this belt alone being prevented from tilting outwardly by the downward pressure of the belt 82. Before the belt 82 moves into contact with the upper ends of the cans, a sheet S (see FIG. 6 etc.) of shrink wrap material is draped over the cans and hangs down on either side of them. It will be noted that the sheet is not symetrically arranged but hangs down further on one side than on the other. Suitable grippers (not shown) can be employed for this purpose.

The chains 30 move in the direction indicated by the arrows in FIG. 2 and thus move upwardly along the inclined chain portion 30.1. At a point slightly to the right of the point where the cans are transferred from the belts 50 to the belt 44, the chains encounter the guides 80 and enter their horizontal runs 30.2. As stated they are maintained exactly horizontal by the chain guides 80. The platforms are, at this stage, slightly below the level of the belt 44 as will be seen from FIG. 7.

Figure 8:
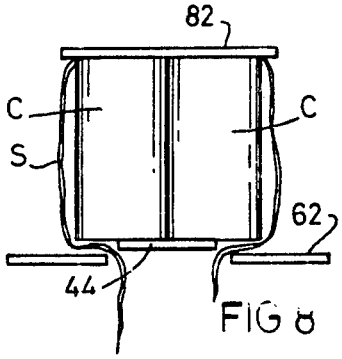

Almost immediately after the platforms 62 enter the horizontal run 30.2, the followers 76 encounter the cam tracks 78 and the platforms move inwardly to the position shown in FIG. 8. In so doing, they move the hanging edges of the sheet S beneath the cans to commence the formation of the sleeve.

Figure 9:
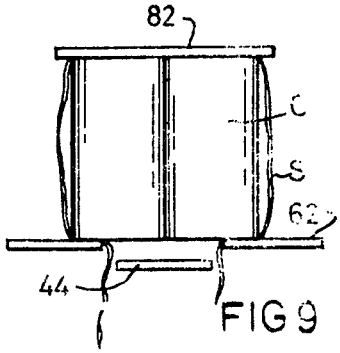

The next stage is as shown in FIG. 9 and this occurs as the group of cans reaches the inclined run of the belt 44. The effect is to "lower" the cans onto the platforms 62 as shown in FIG. 9, whereafter the belt 44 moves downwardly out of engagement with the cans.

Figure 10:
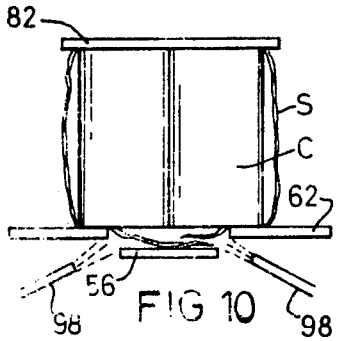
Figure 11:
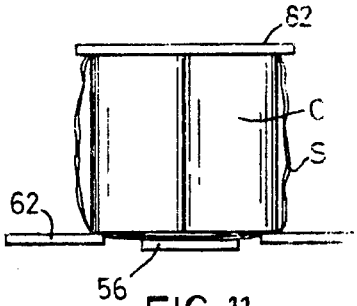
Figure 12:
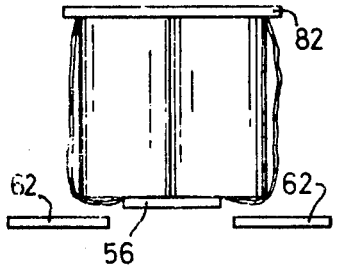

Thus the cans are now supported entirely by the platforms and are moving towards the upwardly inclined belt 56. This belt has a dual function. Eventually it takes over from the platforms 62 the function of supporting the cans. Additionally, it has the function of completing the folding of the hanging edges of the sheet S so that these overlap one another. To ensure that the hanging edges are so positioned that the belt 56 functions in the desired manner, mechanical ploughs or preferably air blasts 98 (diagrammatically shown in FIG. 10) are provided for displacing the hanging edges of the sheet S inwardly as shown in FIG. 10. Thereafter, the belt 56 moves into engagement with the underside of the assembly of cans C and sheet S. This has the effect firstly, as shown in FIG. 1, of gripping the sheet S and preventing it unwrapping and secondly of lifting the assembly of cans and sheet clear of the platforms (FIG. 12) which thereafter move outwardly as the followers 76 clear the cam tracks 78 and then downwardly to commence the return run. The cans are now supported entirely by the belt 56, against which they are pressed by the belt 82, and are fed onto an output conveyor 100. At a convenient point the overlapping edges of the sheet S beneath the cans are subjected to a blast of hot air or to radiation from a heating element so that the overlapping layers are welded one to the other. Subsequently, the cans pass through a heat shrink tunnel so that the sheet S is drawn tightly around them.

If a relatively stiff wrapping material is being employed then the air blasts or ploughs for folding the sheet material can be omitted. The platforms themselves are sufficient to cause the material to take-up the configuration shown in FIG. 10 and the belt 56, without additional aid, can then complete the overlapping of the two edges of the sheet.

In FIG. 13 there is diagrammatically shown a further embodiment which does not include a belt 56 but in which air is employed to hold the overlapping edge portions of the sheet S against one another. Initial overlapping of the edge portions is effected by means of mechanical ploughs or air blasts (such as are shown at 98) or by the platforms themselves. Upwardly directed air blasts then hold the overlapping edge portions in engagement with one another. The first air blasts encountered can blow air at ambient temperature. Subsequently encountered air blasts blow air at a temperature sufficient to weld the overlapping edge portions together. Thereafter general heating to shrink the wrapping takes place in the tunnel.

In FIG. 13 the air blast is shown as emmanating from an elongated slit nozzle 102 which blows air vertically against the underside of the lowermost edge portion. The nozzle 102 is preferably in sections and electrical heating elements 104 can be provided in those sections which serve to direct hot air at the edge portions for sealing purposes. An air inlet to the slit nozzle 102 is shown at 106.

In the form of apparatus described, the platforms 62 remain at the same horizontal level throughout the upper run 30.2, the cans being lowered onto the platforms as the belt 44 slopes downwardly. However, this is not an essential feature and in an alternative constructional form (FIG. 14) of the apparatus the belts 44 and 55 are replaced by a single belt 108 the upper run of which extends horizontally throughout its length. In this form, the platforms 62 move inwardly and upwardly to lift the cans away from the single belt as shown in FIG. 9. They then move downwardly so that the cans are thereafter supported once more by the single belt. In such a form, air blasts or ploughs are required to force the wrapping material into the gap between the platforms and the single belt and further more guide means are required to ensure that the platforms remain horizontal as they move along the upper run. This can be achieved by securing the front edges of the platforms to the chains and providing guides 110 which co-operate with the rear edges of the platforms to maintain the platforms horizontal. Thus, as the platforms move towards and away from the upper run, they adopt a step-like relationship to one another.

In the constructional forms described, the platforms 62 initiate movement of the hanging edge portions of the wrapping material to their overlapping position. This is not essential and if desired air nozzles can be provided for displacing the hanging edge portions towards their overlapped relationship prior to the stage of FIG. 9 being reached.

I claim:

1. In wrapping apparatus, an article conveying structure comprising a conveyor for supporting an article being wrapped along the central region thereof, drive means for displacing the conveyor in a feed direction through the apparatus, a series of supports on each side of the conveyor, drive means for displacing the supports in the feed direction through the apparatus, means for successively displacing the supports towards said conveyor from opposite sides thereof during movement in the feed direction and at a level below said conveyor, and guiding means for the conveyor and guiding means for the supports for changing the relative levels of the conveyor and supports so as to bring the supports above the conveyor and thereby to transfer, from the conveyor to the supports, articles supported thereby whereby the articles then become supported along edge regions thereof by a support of each series while leaving said central region unsupported.

2. Apparatus according to claim 1, including a further conveyor and means for guiding the further conveyor, the means for guiding the further conveyor and said guiding means for guiding the supports serving to guide the further conveyor and supports so that the relative levels thereof are changed, whereby the further conveyor passes between the supports to a level above that of the supports, thereby to lift from the supports the articles which have been transferred thereto from the first mentioned conveyor and re-support the articles along said central region.

3. Apparatus according to claim 2, in which the first mentioned conveyor is constituted by a first endless conveyor and the further conveyor is constituted by a second endless conveyor, the upper run of the first endless conveyor including a horizontal portion and a downwardly inclined portion and the upper run of the second endless conveyor including an upwardly inclined portion and a horizontal portion, said two series of supports being in the form of respective endless loops which travel along a horizontal run at a level which is below the horizontal portions of the first and second endless conveyors but above the lower ends of the inclined portions of such conveyors.

4. Apparatus according to claim 1, in which said conveyor is an endless conveyor having a horizontal upper run, the supports being guided along a run that commences below the level of said upper run of the endless conveyor, slopes upwardly to a level above the upper run of said endless conveyor, and then slopes downwardly to a level below said upper run, there being means for maintaining the supports horizontal.

5. Apparatus according to claim 1, and comprising means for directing air upwardly between said supporting means for holding overlapped wrapping material against the underside of an article being wrapped while the article is supported along said edge regions.

6. Apparatus according to claim 5, and including means for heating the air directed upwardly between said supporting means.

7. Apparatus according to claim 1, and including means for directing air obliquely with respect to the conveying means and supporting means for displacing to beneath the article being wrapped wrapping material hanging down to a level below said article on each side thereof.

8. A method of wrapping an article comprising placing a sheet of wrapping material over the article so that it hangs down below the article on each side thereof to form edge portions, supporting the article along a central region thereof on conveying means moving in a feed direction while leaving its edge regions unsupported, moving supports transversely with respect to the feed direction to beneath the article from opposite sides thereof while the supports and conveying means move in the feed direction thereby to displace the hanging edge portions of the wrapping material to beneath the article, changing the relative level of the conveying means and the supports to transfer support of the article from the conveying means to the supports which support the article along edge regions thereof with said material between said edge regions and the supporting means, said central region being unsupported, and securing said edge portions to one another along said central region.

9. A method according to claim 8, and comprising blowing air onto said edge portions to force them into overlapping relationship with one another and juxtaposed to the underside of said article.

10. A method according to claim 8, and comprising blowing air upwardly against the overlapping edge portion to hold them juxtaposed.

11. A method according to claim 10, in which the air which is blown upwardly is heated to seal said overlapping edge portions to one another.

12. A method according to claim 8, and comprising subsequently re-supporting the article along said central region with said overlapped edge portions of said wrapping material held between the article and the means now supporting the article along the central region.

13. A method according to claim 12, in which the article travels in a path which is inclined upwardly and then inclined downwardly, the article being transferred from the conveying means to the supporting means while moving upwardly, and transferred to said means now supporting the article while moving downwardly.

14. A method according to claim 12, in which said supports travel along a path which is horizontal, the article being lowered onto the supports by the conveying means and subsequently being lifted therefrom.

* * * * *